US007585459B2

(12) United States Patent
Kejzelman et al.

(10) Patent No.: US 7,585,459 B2
(45) Date of Patent: Sep. 8, 2009

(54) METHOD OF PREPARING IRON-BASED COMPONENTS

(75) Inventors: Mikhail Kejzelman, Malmö (SE); Paul Skoglund, Höganäs (SE); Hilmar Vidarsson, Höganäs (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 10/689,656

(22) Filed: Oct. 22, 2003

(65) Prior Publication Data

US 2004/0123697 A1 Jul. 1, 2004

Related U.S. Application Data

(60) Provisional application No. 60/477,949, filed on Jun. 13, 2003.

(30) Foreign Application Priority Data

Oct. 22, 2002 (SE) ..... 0203134

(51) Int. Cl.
*B22F 1/00* (2006.01)

(52) U.S. Cl. ..... 419/39; 419/38; 419/23; 419/11; 419/66; 75/243

(58) Field of Classification Search ..... 419/66, 419/38, 11, 39; 75/246, 243
See application file for complete search history.

(56) References Cited

U.S. PATENT DOCUMENTS

| | | | | |
|---|---|---|---|---|
| 3,600,201 A | | 8/1971 | Alessi et al. | |
| 3,787,205 A | * | 1/1974 | Church | 419/23 |
| 3,901,661 A | | 8/1975 | Kondo et al. | |
| 3,923,946 A | * | 12/1975 | Meyer | 419/48 |
| 4,011,077 A | * | 3/1977 | Kaufman | 419/35 |
| 4,069,044 A | * | 1/1978 | Mocarski et al. | 75/243 |
| 4,190,441 A | | 2/1980 | Tengzelius et al. | |
| 4,244,738 A | * | 1/1981 | Storchheim | 419/23 |
| 4,331,478 A | * | 5/1982 | Ro et al. | 75/228 |
| 4,547,336 A | * | 10/1985 | Mahrus et al. | 419/31 |
| 4,702,772 A | * | 10/1987 | Engstrom et al. | 75/243 |
| 4,799,955 A | * | 1/1989 | McClellan | 428/570 |
| 4,946,499 A | * | 8/1990 | Sakuranda et al. | 75/343 |

(Continued)

FOREIGN PATENT DOCUMENTS

EP 0 554 009 8/1993

(Continued)

OTHER PUBLICATIONS

Hoeganaes Data Sheet for Anconsteel 85 HP, Hoeganaes.com, pp. 1-7, May 15, 2005.*

(Continued)

*Primary Examiner*—Roy King
*Assistant Examiner*—Christopher Kessler
(74) *Attorney, Agent, or Firm*—Buchanan Ingersoll & Rooney PC

(57) ABSTRACT

The present invention concerns a process for the preparation of high density green compacts comprising the steps of providing an iron-based powder essentially free from fine particles; optionally mixing said powder with graphite and other additives; uniaxially compacting the powder in a die at a compaction pressure of at least about 800 MPa and ejecting the green body. The invention also concerns the powder used in the method.

19 Claims, 2 Drawing Sheets

Example 1

◇ = Less shiny surface

● = Deteriorated surface

U.S. PATENT DOCUMENTS

| | | | | | |
|---|---|---|---|---|---|
| 5,080,712 | A | * | 1/1992 | James et al. | 75/229 |
| 5,154,881 | A | * | 10/1992 | Rutz et al. | 419/37 |
| 5,217,683 | A | * | 6/1993 | Causton | 419/38 |
| 5,269,830 | A | * | 12/1993 | Rabin et al. | 75/246 |
| 5,308,702 | A | * | 5/1994 | Furukimi et al. | 428/403 |
| 5,462,577 | A | * | 10/1995 | Ogura et al. | 75/345 |
| 5,892,164 | A | | 4/1999 | Garg et al. | |
| 6,039,784 | A | * | 3/2000 | Luk | 75/231 |
| 6,068,813 | A | * | 5/2000 | Semel | 419/66 |
| 6,638,335 | B2 | * | 10/2003 | Ozaki et al. | 75/255 |
| 2003/0103858 | A1 | * | 6/2003 | Baran et al. | 419/30 |

FOREIGN PATENT DOCUMENTS

| | | |
|---|---|---|
| GB | 2 315 115 | 1/1998 |

OTHER PUBLICATIONS

B Lynn Ferguson and Randall M. German, "Powder Shaping and Consolidation Technologies," ASM Handbook, vol. 7, 1998, pp. 313-320.*

Hawley's Condensed Chemical Dictionary (online source) "Steel" copyright 2002.*

* cited by examiner

Example 1
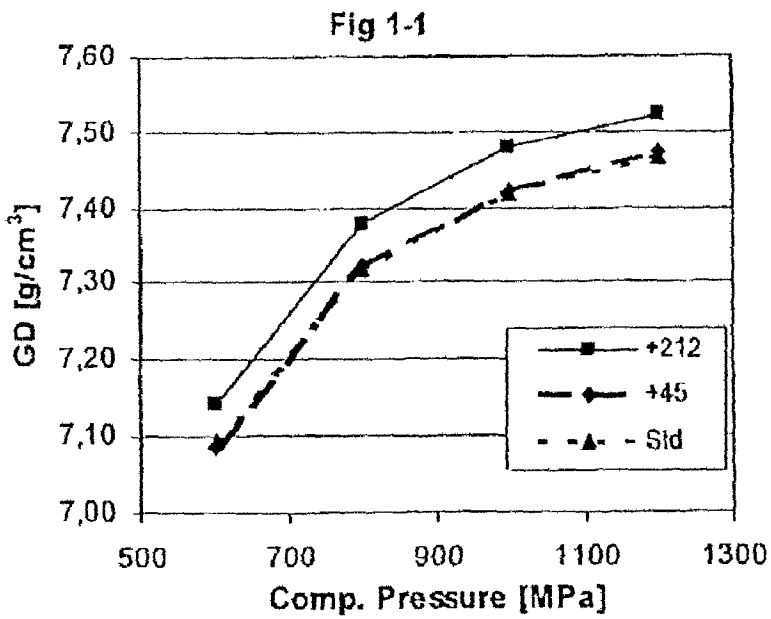
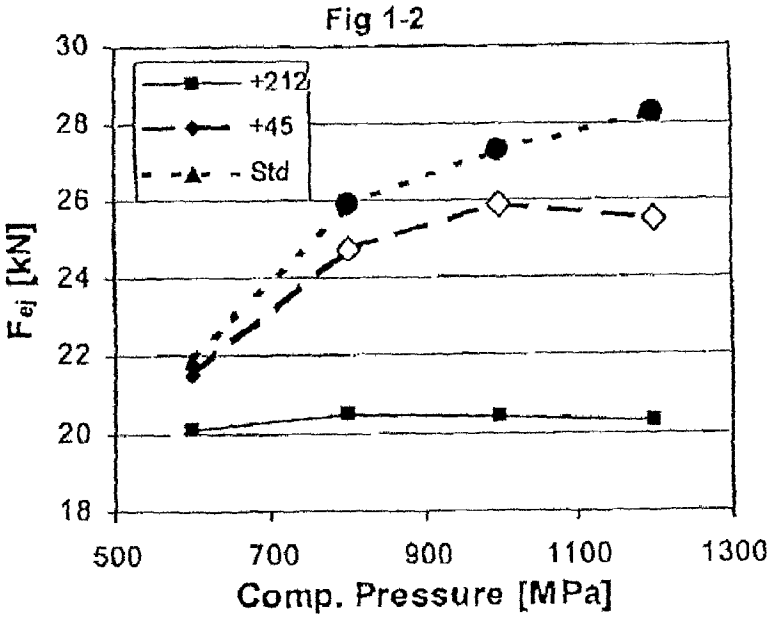
◇ = Less shiny surface
❁ = Deteriorated surface

Example 2
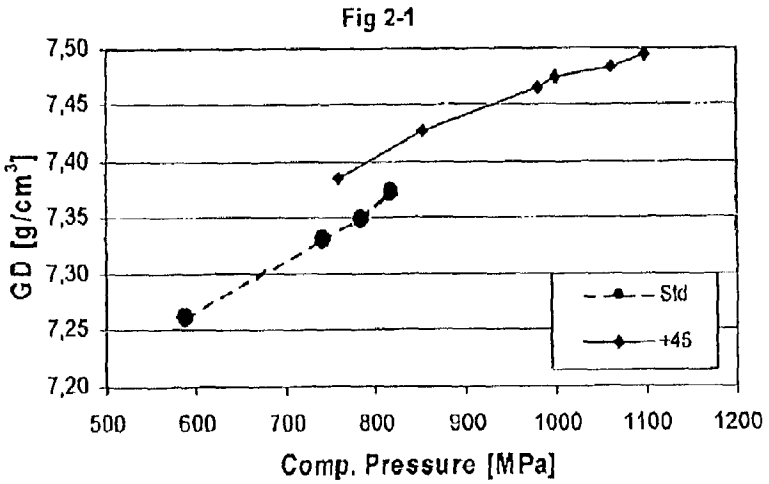
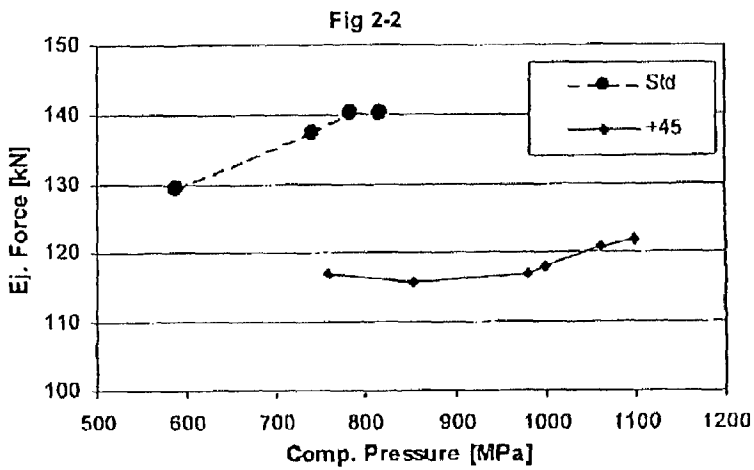
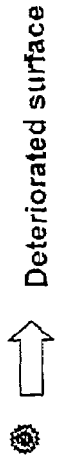

METHOD OF PREPARING IRON-BASED COMPONENTS

Priority is claimed under 35 U.S.C. §119(a) for the filing of Swedish Application No. 0203134-2on Oct. 22, 2002, and under 35 U.S.C. §119(e) for the filing of U.S. Provisional Application No. 60/477,949 on Jun. 13, 2003.

FIELD OF THE INVENTION

The present invention relates to metal powder compositions useful within the powder metallurgical industry. More specifically the invention concerns a method for the preparation of components having high density by using these compositions.

There are several advantages by using powder metallurgical methods for producing structural parts compared with conventional matching processes of full dense steel. Thus, the energy consumption is much lower and the material utilisation is much higher. Another important factor in favour of the powder metallurgical route is that components with net shape or near net shape can be produced directly after the sintering process without costly shaping processes such as turning, milling, boring or grinding. However, normally a full dense steel material has superior mechanical properties compared with PM components. This is mainly due to the occurrence of porosity in the PM components. Therefore, the strive has been to increase the density of PM components in order to reach values as close as possible to the density value of a full dense steel.

Among the methods used in order to reach higher density of PM components the powder forging process has the advantage that full dense components may be obtained. The process is however costly and is utilised mainly for mass production of heavier components, such as connection rods. Full dense materials can also be obtained by elevated pressures at high temperatures, such as in hot isostatic pressing, HIP, but also this method is costly.

By using warm compaction, a process where the compaction is performed at an elevated temperature, typically at 120 to 250° C., the density can be increased with about 0.2 g/cm$^3$, which results in a considerable improvement of the mechanical properties. A disadvantage is however that the warm compaction method involves additional investment and processing. Other processes, such as double pressing, double sintering, sintering at elevated temperatures etc, may further increase the density. Also these methods will add further production costs hence reducing the overall cost effectiveness.

In order to expand the market for powder metallurgical components and utilise the advantages with the powder metallurgical technique there is thus a need for a simple, less expensive method of achieving high density compacts with improved static and dynamic mechanical strength.

SUMMARY OF THE INVENTION

It has now been found that high density components can be obtained by using high compaction pressures in combination with coarse powders. In view of the general knowledge, that conventionally used powders, i.e. powders including fine particles, cannot be compacted to high densities without problems with e.g. damaged or deteriorated surfaces of the compacts this finding is quite unexpected. Specifically, the method according to the present invention includes the steps of providing an iron-based powder essentially free from fine particles; optionally mixing said powder with graphite and other additives; uniaxially compacting the powder in a die at high pressure and ejecting the green body, which may subsequently be sintered.

BRIEF DESCRIPTION OF THE DRAWINGS

FIGS. 1-1 and 1-2 illustrate higher green density and lower ejection force according to one aspect of the invention.

FIGS. 2-1 and 2-2 illustrate higher green density and lower ejection force according to another aspect of the invention.

DETAILED DESCRIPTION OF THE. INVENTION

The term "high density" is intended to mean compacts having a density of about at least 7.3 g/cm$^3$. Components having lower densities can of course also be produced but are believed to be of less interest.

The iron-based powder according to the present invention includes pure iron powder such as atomised iron powder, sponge iron powder, reduced iron powder; partially diffusion-alloyed steel powder; and completely alloyed steel powder. The partially diffusion-alloyed steel powder is preferably a steel powder alloyed partially with one or more of Cu, Ni, and Mo. The completely alloyed steel powder is preferably a steel powder alloyed with Mn, Cu, Ni, Cr, Mo, V, Co, W, Nb, Ti, Al, P, S and B. Also stainless steel powders are of interest.

As regards the particle shape it is preferred that the particles have an irregular form as is obtained by water atomisation. Also sponge iron powders having irregularly shaped particles may be of interest.

A critical feature of the invention is that the powder used have coarse particles i.e. the powder is essentially without fine particles. The term "essentially without fine particles" is intended to mean that less than about 5% of the powder particles have a size below 45 μm as measured by the method described in SS-EN 24 497. So far the most interesting results have been achieved with powders essentially consisting of particles above about 106 μm and particularly above about 212 μm. The term "essentially consists" is intended to mean that at least 50%, preferably at least 60%, and most preferably at least 70% of the particles have a particle size above 106 and 212 μm, respectively. The maximum particle size may be about 2 mm. The particle size distribution for iron-based powders used at PM manufacturing is normally distributed with a gaussian distribution with a average particle diameter in the region of 30 to 100 μm and about 10-30% less than 45 μm. Iron based powders essentially free from fine particles may be obtained by removing the finer fractions of the powder or by manufacturing a powder having the desired particle size distribution.

The influence of particle size distribution and the influence of particle shape on the compaction properties and properties of the compacted body have been subjected to intense studies. Thus the U.S. Pat. No. 5,594,186 reveals a method of producing PM components with a density higher than 95% of theoretical density by utilising substantially linear, acicular metal particles having a triangular cross section. Such particles are suitably produced by a machining or milling process.

Powders having coarse particles are also used for the manufacture of soft magnetic components. Thus U.S. Pat. No. 6,309,748 discloses a ferromagnetic powder, the particles of which have a diameter size between 40 and 600 μm. In contrast to iron based powder particles according to the present invention, these powder particles are provided with a coating.

In the U.S. Pat. No. 4,190,441 a powder composition for production of sintered soft magnetic components is disclosed. In this patent the iron powder includes particles with less than 5% exceeding 417 μm, and less than about 20% of the powder particles have a size less than 147 μm. This patent teaches that, because of the very low content of particles less than 147 μm, the mechanical properties of components manufactured from this coarse, highly pure powder are very low. Furthermore the patent teaches that if higher strength is desired, it is not possible to increase the content of particles having a size less than 147 μm without simultaneously deteriorating the soft magnetic properties. Therefore this powder is mixed with specific amounts of ferrophosphorus. Graphite which may be used in the compositions according to the present invention is not mentioned in this patent and besides the presence of graphite would deteriorate the magnetic properties.

Powder mixtures including coarse particles are also disclosed in U.S. Pat. No. 5,225,459 (EP 554 009) which also concerns powder mixtures for the preparation of soft magnetic components. Nor do these powder mixtures include graphite.

Within the field of powder forging it is furthermore known that pre-alloyed iron-based powders with coarse particles can be used. U.S. Pat. No. 3,901,661 discloses such powders. This patent discloses that a lubricant maybe be included and specifically that the amount of lubricant should be 1% by weight (example 1). If the powders according to the present invention were mixed with such a high amount of lubricant it would however not be possible to achieve the high densities.

In order to obtain compacts having satisfactory mechanical sintered properties of the sintered part according to the present invention it is necessary to add certain amounts of graphite to the powder mixture to be compacted. Thus graphite in amounts between 0.1-1, preferably 0.2-1.0 and most preferably 0.2-0.8% by weight of the total mixture to be compacted could be added before the compaction.

Other additives may be added to the iron-based powder before compaction such as alloying elements comprising Mn, Cu, Ni, Cr, Mo, V, Co, W, Nb, Ti, Al, P, S, and B. These alloying elements may be added in amounts up to 10% by weight. Further additives are machinability enhancing compounds, hard phase material and flow agents.

The iron-base powder may also be combined with a lubricant before it is transferred to the die (internal lubrication). The lubricant is added to minimize friction between the metal power particles and between the particles and the die during a compaction, or pressing, step. Examples of suitable lubricants are e.g. stearates, waxes, fatty acids and derivatives thereof, oligomers, polymers and other organic substances with lubricating effect. The lubricants are preferably added in the form of particles but may also be bonded and/or coated to the particles. According to the present invention the amount of lubricant added to the iron-based powder may vary between 0.05 and 0.6%, preferably between 0.1-0.5% by weight of the mixture.

The method according to the invention may also be performed with the use of external lubrication (die wall lubrication) where the walls of the die are provided with a lubricant before the compaction is performed. A combination of external and internal lubrication may also be used.

The term "at high compaction pressure" is intended to mean at pressures of about at least 800 MPa. More interesting results are obtained with higher pressures such as pressures above 900, preferably above 1000, more preferably above 1100 MPa.

Conventional compaction at high pressures, i.e. pressures above about 800 MPa with conventionally used powders including finer particles, in admixture with low amounts of lubricants (less than 0.6% by weight) are generally considered unsuitable due to the high forces required in order to eject the compacts from the die, the accompanying high wear of the die and the fact that the surfaces of the components tend to be less shiny or deteriorated. By using the powders according to the present invention it has unexpectedly been found that the ejection force is reduced at high pressures, about 1000 MPa, and that components having acceptable or even perfect surfaces may be obtained also when die wall lubrication is not used.

The compaction may be performed with standard equipment, which means that the new method may be performed without expensive investments. The compaction is performed uniaxially in a single step at ambient or elevated temperature. Alternatively the compaction may, be performed with the aid of a percussion machine (Model HYP 35-4 from Hydropulsor) as described in patent publication. WO 02/38315.

The sintering may be performed at temperatures normally used within the PM field, e.g. at standard temperature between 1080 and 1160° C. or at higher temperatures above 1160° C. and in conventionally used atmospheres.

Other treatments of the green or sintered component may as well be applied, such as machining case hardening, surface densification or other methods used in PM technology.

In brief the advantages obtained by using the method according to the present invention are that high density green compacts can be cost effectively produced. The new method also permits production of higher components which are difficult to produce by using the conventional technique. Additionally standard compaction equipment can be used for producing high density compacts having acceptable or even perfect surface finish.

Examples of products which suitably can be manufactured by the new method are connecting rods, gears and other structural parts subjected to high loads. By using stainless steel powders flanges are of special interest.

The invention is further illustrated by the following examples.

EXAMPLE 1

Two different iron-based powder compositions according to the present invention were compared with a standard iron-based powder composition. All three compositions were produced with Astaloy Mo available from Höganäs AB, Sweden. 0.2% by weight of graphite and 0.4% by weight of a lubricant (Kenolube™) were added to the compositions. In one of the iron-based powder compositions according to the invention, particles of the Astaloy Mo with a diameter less than 45 μm were removed and in the other composition according to the invention particles of Astaloy Mo less than 212 μm were removed. The compaction was performed at ambient temperature and in standard equipment. As can be seen from FIG. 1-1 a clear density increase at all compaction pressures is obtained with the powder having a particle size above 212 μm.

FIG. 1-2 shows that in order to obtain components without deteriorated surfaces the most important factor is the reduction or elimination of the smallest particles, i.e. particles below 45 μm. Furthermore from this figure it can be seen that the force needed for ejection of the compacts produced by the iron based powder composition without particles less than 212 μm was considerably reduced compared with the ejection force needed for compacts produced from the standard iron-based powder composition having about 20% of the particles less than 45 μm. The ejection force needed for compacts produced from the iron-based powder composition according to the invention without particles less than 45 μm is also reduced in comparison with the standard powder.

A noticeable phenomenon is that the ejection force for compacts produced according to the present invention decreases with the increasing ejection pressure whereas the opposite is valid for the standard composition.

It was also observed that the compacts obtained when the standard powder was compacted at a pressure above 700 MPa had deteriorated surfaces and were accordingly not acceptable. The compacts, which were obtained when the powder essentially without particles less than 45 μm was compacted at a pressure above 700 MPa, had a less shiny surface winch at least under certain circumstances is acceptable.

EXAMPLE 2

Example 1 was repeated but as lubricant 0.5% of EBS (ethylene bisstearamide) was used and the compaction was performed with the aid of a percussion machine (Model HYP 35-4 from Hydropulsor, Sweden)

From FIGS. 2-1 and 2-2, respectively, it can be noticed that higher green densities and lower ejection forces were obtained with the powder composition according to the invention compared with the powder composition with the standard, powder. It can also be noticed that components produced from the standard powder had deteriorated surfaces at all compaction pressures.

The invention claimed is:

1. A process for preparing high density green compacts comprising the following steps:

(a) subjecting a composition of a water-atomized, completely alloyed steel powder, wherein less than about 5% of the powder particles have a size below 45 μm, and a lubricant added to the powder in an amount between about 0.05% and about 0.6% by weight, to uniaxial compaction in a die at a compaction pressure of at least about 800 MPa, wherein the compaction is performed in a single step; and (b) ejecting the green body from the die.

2. The process of claim 1, further comprising mixing said powder with graphite and other additives.

3. The process of claim 1, wherein at least about 50% of the powder consists of particles having a particle size above about 106 μm.

4. The process of claim 1, wherein at least about 60% of the powder consists of particles having a particle size above about 106 μm.

5. The process of claim 1, wherein at least about 70% of the powder consists of particles having a particle size above about 106 μm.

6. The process of claim 1, wherein at least 50% of the powder consists of particles having a particle size above about 212 μm.

7. The process of claim 6, wherein at least 60% of the powder consists of particles having a particle size above about 212 μm.

8. The process of claim 6, wherein at least 70% of the powder consists of particles having a particle size above about 212 μm.

9. The process of claim 6, wherein the maximum particle size is about 2 mm.

10. The process of claim 2, wherein the graphite is present in an amount of about 0.1 to 1.0%.

11. The process of claim 2, wherein the additives are selected from the group consisting of alloying elements, machinability enhancing agents, hard phase materials and flow agents.

12. The process of claim 1, wherein the compaction is performed at a pressure of at least 900 MPa.

13. The process of claim 12, wherein the compaction is performed at a pressure of at least 1000 MPa.

14. The process of claim 12, wherein the compaction is performed at a pressure of at least 1100 MPa.

15. The process of claim 1, wherein the compaction is performed at ambient temperature.

16. The process of claim 1, wherein the compaction is performed at elevated temperature.

17. The process of claim 1, further comprising sintering in a single step at a temperature above 1100° C.

18. The process of claim 11, wherein the alloying elements are selected from the group consisting of Mn, Cu, Ni, Cr, Mo, V, Co, W, Nb, Ti, Al, P, S and B.

19. The process of claim 1, wherein the compaction is performed without using external lubrication.

* * * * *